US005413169A

United States Patent [19]

Frazier et al.

[11] Patent Number: 5,413,169

[45] Date of Patent: May 9, 1995

[54] AUTOMOTIVE EVAPORATOR MANIFOLD

[75] Inventors: Kathleen L. Frazier, Farmington Hills, Mich.; Kevin B. Wise, Connersville, Ind.; Michael A. Breda, Livonia, Mich.

[73] Assignee: Ford Motor Company, Dearborn, Mich.

[21] Appl. No.: 168,307

[22] Filed: Dec. 17, 1993

[51] Int. Cl.[6] ..... F28D 1/03

[52] U.S. Cl. ..... 165/153; 165/176

[58] Field of Search ..... 165/153, 176, 178

[56] References Cited

U.S. PATENT DOCUMENTS

| | | | |
|---|---|---|---|
| 3,668,757 | 6/1972 | Rieder . | |
| 4,019,573 | 4/1977 | Modine | 165/175 |
| 4,487,038 | 12/1984 | Iijima . | |
| 4,775,006 | 10/1988 | Hesse . | |
| 4,856,824 | 8/1989 | Clausen . | |
| 4,967,834 | 11/1990 | Tokizaki et al. | 165/153 |
| 4,969,512 | 11/1990 | Hisao et al. . | |
| 5,042,577 | 8/1991 | Suzumura . | |
| 5,094,293 | 3/1992 | Shinmura . | |
| 5,125,453 | 6/1992 | Bertrand et al. . | |
| 5,197,539 | 3/1993 | Hughes et al. . | |

FOREIGN PATENT DOCUMENTS

| | | | |
|---|---|---|---|
| 62-13995 | 1/1987 | Japan | 165/153 |
| 4-169794 | 6/1992 | Japan | 165/153 |

*Primary Examiner*—Allen J. Flanigan

*Attorney, Agent, or Firm*—Raymond L. Coppiellie; Roger L. May

[57] ABSTRACT

A plate-fin heat exchanger 10 is disclosed including a plurality of flat pipes 14 interleaved with a plurality of fin members 16. The flat pipes 14 are formed from a plurality of plate members 12. The heat exchanger 10 also includes a plurality of fin members 16 and a pair of fluid manifolds 22, 24. The manifolds 22, 24 engage the heat exchanger 10 along either of two axes which are perpendicular to the longitudinal axis of the tank 20 of the heat exchanger 10.

11 Claims, 2 Drawing Sheets

AUTOMOTIVE EVAPORATOR MANIFOLD

BACKGROUND OF THE INVENTION

1. Field of the Invention

The present invention relates generally to a heat exchanger for an automotive vehicle. More particularly, the present invention relates to a manifold for use in a plate-fin type evaporator for an automotive vehicle.

2. Disclosure information

Plate-fin heat exchangers are well known in the art. In these types of heat exchangers, a plurality of elongated plates are joined together, such as through a lamination process to define a plurality of passageways for the movement of a fluid therethrough. Each of the passageways is formed by the inwardly facing surfaces of a pair of joined plates so as to form a flat pipe. The interior surfaces of the joined plates generally define a central fluid conducting section. The passageways are interconnected so that a fluid may flow through the plurality of joined plates forming the heat exchanger. As is also known in the art, conductive fin strips are located between outwardly facing surfaces of the pairs of joined plates. Heat exchangers of this type have particular utility as evaporators for air conditioning systems of motor vehicles.

Typically, plate-fin heat exchangers are manufactured by stacking a plurality of individual plates together to form a flat pipe and interleaving fin members between each pipe. An inlet and outlet manifold are then inserted between a pair of pipes to provide for fluid communication into and out of the evaporator. Endsheets are then placed on opposite ends of the heat exchanger to form a heat exchanger core and the core is brazed in a furnace to complete the manufacturing process.

Various types of manifold designs have been proposed for use in a plate-fin type heat exchanger. For example, U.S. Pat. No. 4,487,038 discloses a two-piece manifold wherein the manifold is formed from a pair of semi-tubular members joined together in an abutting manner. However, a two-piece manifold assembly can often leak if the braze between the two pieces is not performed properly. Therefore, it would be advantageous to provide a manifold for a heat exchanger which eliminates the need for a brazing operation to be performed on the manifold to ensure a leak-free component.

SUMMARY OF THE INVENTION

The present invention overcomes the above problems with the prior art by providing a heat exchanger for an automotive vehicle comprising a plurality of flat pipes arranged parallel to and in fluid communication with one another for allowing the flow of a heat exchange fluid therethrough. Each of the flat pipes comprises a pair of generally planar plates joined together in abutting face-to-face relationship to form a flat pipe. Each plate includes an end portion having a cup member with an aperture therein and wherein the cup members are joined together to form a tank having a longitudinal axis generally perpendicular to the longitudinal axis of the plate members. The tank allows fluid to flow therethrough to each of the flat pipes. The heat exchanger further includes a plurality of fin members interleaved between the plurality of flat pipes and a pair of endsheet members attached to the outermost ones of the flat pipes. The heat exchanger further includes a pair of fluid manifolds for the inlet and outlet of heat exchange fluid to and from the heat exchanger respectively. Each of the manifolds comprises a unitary member having a fluid opening end, a closed end and at least one aperture through which fluid flows into the tank. The manifolds are configured to engage the tank such that the fluid opening end can be arranged generally parallel to either of the two axes which are perpendicular to the longitudinal axis of the tank. The flat pipes, the fin members and the endsheet members and the pair of manifolds are then brazed together to form an integral body. In the preferred embodiment, the manifold is formed as a unitary piece from an extrusion process out of an aluminum alloy.

It is an advantage of the present invention to provide a manifold for a heat exchanger for an automotive vehicle wherein the manifold can be arranged along either of two axes perpendicular to the longitudinal axes of the evaporator tank and which is formed as a unitary piece to prevent leakage from the manifold. These and Other objects, features and advantages of the present invention will become apparent from the drawings, detailed description and claims which follow.

DETAILED DESCRIPTION OF THE PREFERRED EMBODIMENTS

Figure 2:
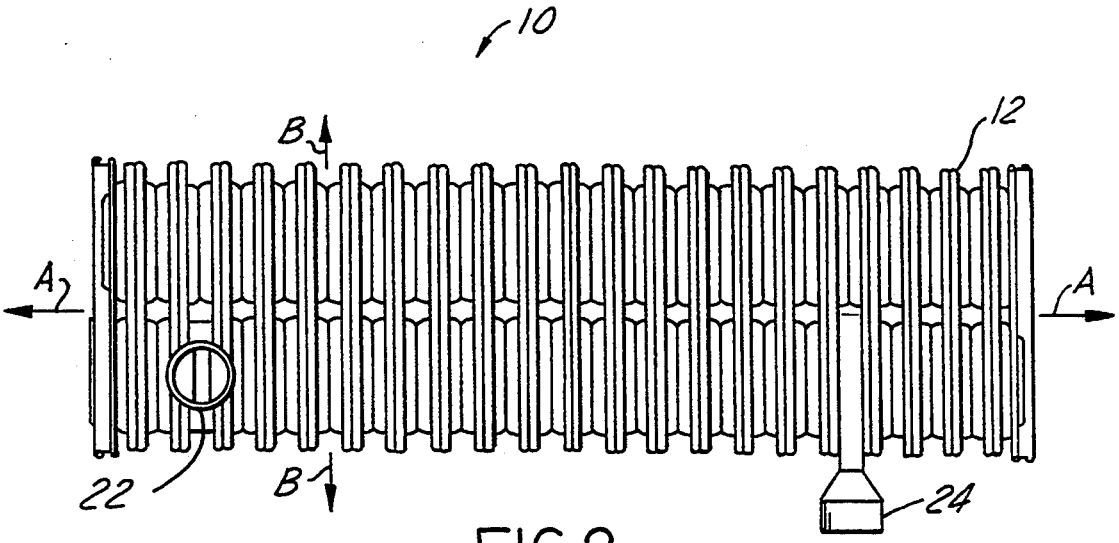
FIG. 2 is a top plan view of the heat exchanger of FIG. 1.
Figure 1:
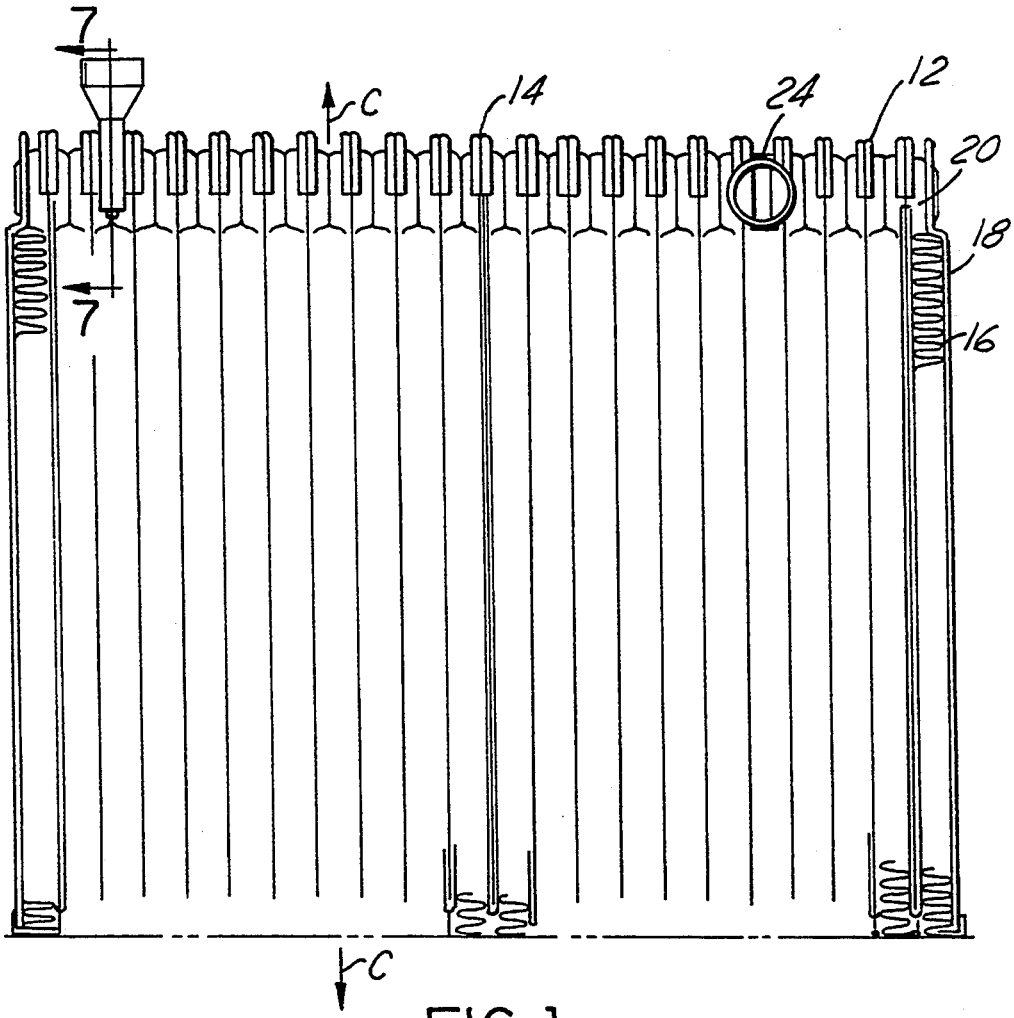
FIG. 1 is a perspective view of a heat exchanger structured in accord with the principles of the present invention.

Referring now to the drawings, FIGS. 1 and 2 show a plate-fin heat exchanger, generally designated by the numeral 10, in the form of an evaporator particularly adapted for use in an automobile air conditioning system. The evaporator 10 comprises a stack of formed, elongated plates 12, pairs of which are joined together in abutting face-to-face relationship so that adjacent pairs form flat fluid pipes 14 which provide alternate passageways for the flow of a refrigerant fluid therebetween. The plates may be joined in any of a variety of known processes, such as through brazing or a lamination process. Heat transfer fins 16 are positioned between flat pipes 14 to provide increased heat transfer area as is well known in the art. The flat pipes and fin assemblies are contained within endsheets 18.

As will be described in greater detail below, one or both ends of each of the plates 14 includes a cup portion which, when joined together, forms a fluid tank 20 for allowing the flow of fluid through the evaporator 10. As shown in FIG. 2, the tank 20 has a longitudinal axis as designated by the line A—A. The evaporator 10 further includes an inlet manifold 22 and an outlet manifold 24 in fluid communication with the tank 20 at one end of the evaporator 10. The tank 20 is in direct communication with the passageways of the pipes 14 and as will become apparent from the following description, the pipes have aligned apertures at one end thereof providing communication between the inlet and outlet manifolds 22, 24 respectively of tank 20. In the heat exchanger of FIGS. 1 and 2, refrigerant is directed into inlet manifold 22 and passes through the plurality of flat pipes 14 in a known manner. The refrigerant then exits through the outlet manifold 24 to complete the cooling cycle.

The manufacture of the plate-fin evaporator 10 is accomplished in a manner well known in the art. The plurality of formed elongated plates are generally formed from an aluminum material coated with an aluminum brazing alloy. The various components forming the entire unit are made from aluminum stock, then assembled as shown in FIGS. 1 and 2, and passed through a vacuum brazing operation in which the metal brazes together to form an integrated unit. Alternatively, other known processes may be used in the manufacture of the evaporator 10. The present invention is not meant to be limited to a specific manufacturing process.

Figure 5:
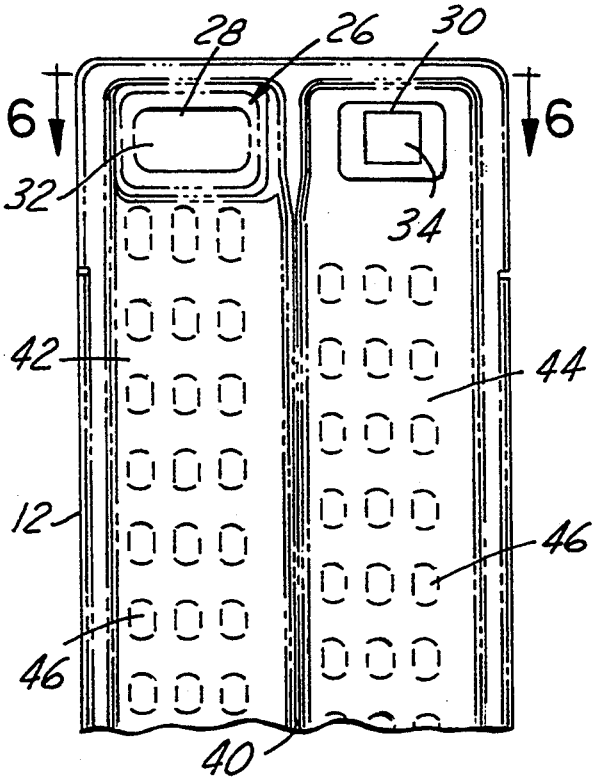
FIG. 5 is an elevational view of a plate for use in the heat exchanger FIG. 1, structured in accord with the principles of the present invention.
Figure 7:
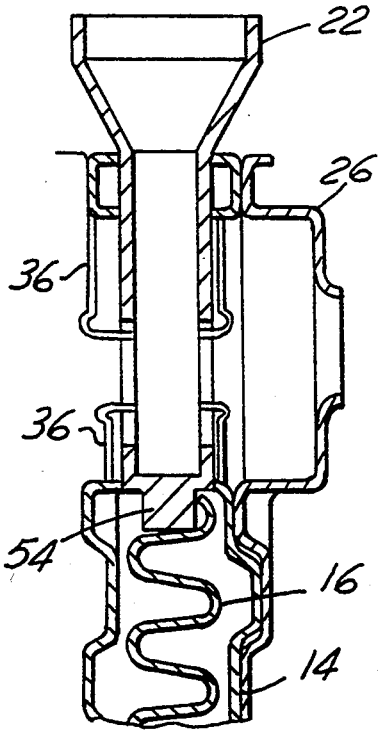
FIG. 7 is a cross-sectional view taken along line 7—7 of FIG. 1.
Figure 6:
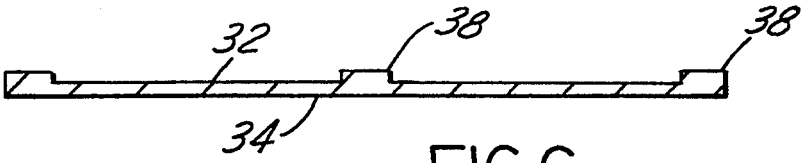
FIG. 6 is a cross-sectional view taken along line 6—6 of FIG. 5.

Referring now to FIGS. 5–7, evaporator 10 of the present invention includes a plurality of generally elongated plates 12 laminated together to form the flat pipes 14. Each of the pipes is generally identical and includes a cup portion 26 disposed at one end thereof. The cup portion may extend transversely across the entire width of the plate or alternatively, as shown in FIG. 5, may be divided into two separate cup portions depending upon the configuration of the plate 14. In the present invention, the plate 14 includes a fluid inlet cup 28 and fluid outlet cup 30 each having an aperture 32, 34 respectively for allowing fluid to flow therethrough. The plate as shown in FIG. 5 is divided into two fluid conducting portions, a first portion 42 and a second portion 44 separated by a rib 40 which extends generally the entire length of the plate 12 and which is disclosed in more detail in U.S. Pat. No. 5,125,453, assigned to the assignee of the present invention and the disclosure of which is hereby incorporated by reference. As is well known in the art, each of the evaporator plates 12 includes a plurality of raised beads 46 arranged in a predetermined pattern. The raised beads create turbulence in the fluid as the fluid flows through each of the flat pipes 14 thereby increasing the heat transfer characteristics of the evaporator 10. Each of the cup portions 28, 30 can be joined with the cup portions of adjacent pipes 14 to form the tank 20 described above. The connections of the cup portions to adjacent cup portions is well described in the '453 patent.

As shown in FIGS. 6 and 7, one of the apertures of the cup portions, aperture 32 of cup portion 28 as shown, includes a locating flange 36 disposed around the periphery of the aperture 32. The locating flange 36 engages an aperture formed in the manifold 22 to properly fix the manifold in a correct location relative to the position between two adjacent flat pipes 12. The locating flange also prevents the manifold from rotating relative to the tank during the assembly process. Should the manifold 22 rotate out of position during the assembly process, the manifold would have to be scrapped resulting in unnecessary waste. If the manifold is not correctly positioned, leakage could occur resulting in a decrease in efficiency of the evaporator 10.

The other of the cup portions, herein the cup portion 30 also includes an aperture 34 around which a pair of shoulder members 38 are formed. The shoulder members 38 provide for assembly clearance of the manifold relative to the evaporator core during manufacturing.

Figure 3:
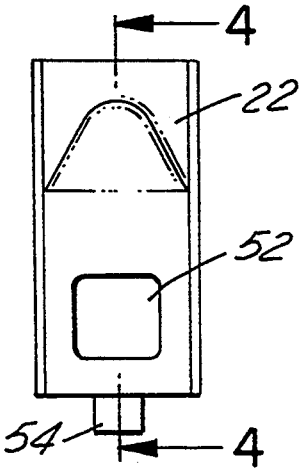
FIG. 3 is a perspective view of a manifold structured in accord with the principles of the present invention.
Figure 4:
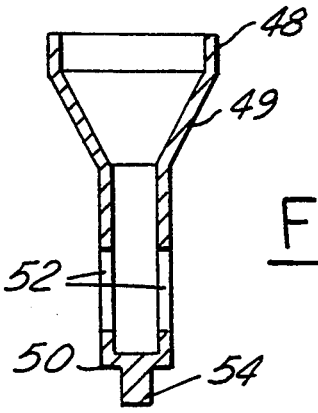
FIG. 4 is a cross-sectional view taken along line 4—4 of FIG. 3.

Referring now to FIGS. 3 and 4, the manifold 22 will be described in detail. Each of the manifolds 22, 24 is formed as a unitary member during an extrusion process. The manifolds can be formed from any alloy but preferably from an aluminum alloy. By forming the manifolds as a unitary member, the manifold will not leak due to insufficient brazing of a plurality of pieces such as has been done prior to the present invention. The manifold 22 includes a generally circular fluid opening end which funnels down through a transition portion 49 to a closed end 50. As shown, the closed end 50 is generally rectangular to ensure a cooperative fit of the manifold between adjacent flat pipe members 14. The manifold includes at least one aperture 52 through which the fluid flows into the tank of the evaporator 10. As shown herein, manifold 22 includes a pair of apertures.

Additionally, the manifold may include a fin pushing tab 54 which, as can clearly be seen in FIG. 7, holds the fin member 16 aside while the manifold is being inserted into the evaporator core. Because of the curvature and elasticity of the fin members 16, the fin members tend to exert a force against the closed end 50 of the manifold, forcing the manifold out of its correct position in the evaporator core. This could also result in leakage due to improper sealing of the manifold to the evaporator 10. The tab member 54 holds the fin member 16 down and away from the manifold to prevent such condition. The tab member 54 also prevents the cutoff end of the fin member 16 from being pinched in between the manifold 22 and the plate 12. A fin pinched as such can also result in a leak.

Referring back to FIGS. 1 and 2, utilizing a manifold in accordance with the present invention provides the advantage that the manifold may engage the tank of the evaporator such that the fluid opening end 48 of the manifold can be arranged generally parallel to either of the two axes which are perpendicular to the longitudinal axes of the tank. Shown in FIGS. 1 and 2, the manifold 22 is arranged so that the fluid opening end 48 is generally parallel to the axis designated by line C—C. The manifold 24 is arranged such that the fluid opening end 48 is arranged generally parallel to the axis defined by line B—B. This offers a unique advantage in terms of packaging the evaporator for specific vehicle models. Typically, due to the ever shrinking engine compartment space in most vehicles today, it is difficult to arrange the fluid inlet and fluid outlet pipe couplings to the evaporator given that the evaporator can only be arranged in one orientation. The present invention solves this problem by providing that the fluid manifolds can be arranged either both parallel to the axis defined by C—C or both parallel to the axis B—B or some combination thereof such as shown in FIGS. 1 and 2.

Various modifications and alterations of the present invention will, no doubt, occur to those skilled in the art, to which this invention pertains. These and all other variations which rely upon the teachings by which this disclosure has advanced the art are properly considered within the scope of this invention as defined by the appended claims.

What is claimed is:

1. A heat exchanger for an automotive vehicle, comprising:

a plurality of flat pipes arranged parallel to and in fluid communication with one another for allowing the flow of a heat exchange fluid therethrough, each of said flat pipes comprising a pair of generally planar plates joined together in abutting face-to-face relationship, each plate including an end portion having a cup member with an aperture therein and wherein said cup members are configured to be joined together to form a tank having a longitudinal axis generally perpendicular to the longitudinal axis of said plates, said tank allowing fluid to flow therethrough;

a plurality of fin members interleaved between the plurality of flat pipes;

a pair of endsheet members attached to the outermost ones of said flat pipes;

a pair of fluid manifolds for the inlet and outlet of heat exchange fluid to and from said heat exchanger, respectively, each of said manifolds comprising a unitary member having a fluid opening end, a closed end and at least one aperture through which fluid flows into said tank, said pair of manifolds being configured to engage said tank such that the fluid opening end can be arranged generally parallel to either of the two axes perpendicular to the longitudinal axis of said tank;

and wherein said flat pipes, said fin members, said endsheet members and said pair of manifolds are brazed together to form an integral body.

2. A heat exchanger according to claim 1, wherein each of said plates is identical and includes a pair of apertures formed in said cup portion.

3. A heat exchanger according to claim 2, wherein at least one of said apertures includes a locating flange disposed around the periphery of said aperture, said locating flange being operative to engage said manifold aperture.

4. A heat exchanger according to claim 3, wherein said manifold includes a pair of apertures through which fluid flows therethrough into said tank.

5. A heat exchanger according to claim 1, wherein each of said manifolds includes a generally circular fluid opening end and a generally rectangular closed end.

6. A heat exchanger according to claim 1, wherein said closed end of each of said manifolds includes a tab member operative to contact said fin member upon insertion of said manifold between a pair of flat pipes.

7. A heat exchanger according to claim 1, wherein said manifolds are formed as a unitary piece from an extrusion process.

8. A heat exchanger according to claim 7, wherein said manifolds are formed from an aluminum alloy.

9. A heat exchanger according to claim 1, wherein each of said plates includes a plurality of raised beads arranged in a predetermined pattern for creating turbulence in the fluid as the fluid flows through said flat pipes.

10. An evaporator for an automotive vehicle, comprising:

a plurality of flat pipes arranged parallel to and in fluid communication with one another for allowing the flow of a heat exchange fluid therethrough, each of said flat pipes comprising:

a pair of generally identical, planar plates joined together in abutting face-to-face relationship, each plate including:

an end portion having a cup member formed thereat and wherein said cup members are configured to be joined together to form a tank having a longitudinal axis generally perpendicular to the longitudinal axis of said plate members, said tank allowing fluid to flow therethrough, each cup portion including a pair of apertures therein for fluid to flow therethrough, one of said apertures including a locating flange disposed around the periphery of said aperture and the other aperture including a pair of shoulders disposed around an outer edge thereof;

a plurality of raised beads arranged in a predetermined pattern for creating turbulence in the fluid as the fluid flows through said flat pipes;

a plurality of fin members interleaved between the plurality of flat pipes;

a pair of endsheet members attached to the outermost ones of said flat pipes;

a pair of fluid manifolds for the inlet and outlet of heat exchange fluid to and from said evaporator, respectively, each of said manifolds comprising an extruded, unitary mender having a fluid opening end, a closed end and a pair of apertures through which fluid flows into said tank, said pair of manifolds being configured to engage said tank such that the fluid opening end can be arranged generally parallel to either of the two axes perpendicular to the longitudinal axis of said tank;

and wherein said flat pipes, said fin members, said endsheet members and said pair of manifolds are brazed together to form an integral body.

11. A heat exchanger for an automotive vehicle, comprising:

a plurality of flat pipes arranged parallel to and in fluid communication with one another for allowing the flow of a heat exchange fluid therethrough, each of said flat pipes comprising a pair of substantially identical, generally planar plates joined together in abutting face-to-face relationship, each plate including an end portion having a cup member with a pair of apertures therein and wherein said cup members are configured to be joined together to form a tank having a longitudinal axis generally perpendicular to the longitudinal axis of said plate members, said tank allowing fluid to flow therethrough;

a plurality of fin members interleaved between the plurality of flat pipes;

a pair of endsheet members attached to the outermost ones of said flat pipes;

a pair of fluid manifolds for the inlet and outlet of heat exchange fluid to and from said heat exchanger, respectively, each of said manifolds comprising a unitary member having a fluid opening end, a closed end and at least one aperture through which fluid flows into said tank, said pair of manifolds being configured to engage said tank such that the fluid opening end can be arranged generally parallel to either of the two axes perpendicular to the longitudinal axis of said tank;

a locating flange disposed around the periphery of at least one said aperture in one said cup member, said locating flange being operative to engage said manifold aperture;

and wherein said flat pipes, said fin members, said endsheet members and said pair of manifolds are brazed together to form an integral body.

* * * * *